United States Patent [19]

Vaughn

[11] Patent Number: 4,813,341

[45] Date of Patent: Mar. 21, 1989

[54] PNEUMATIC CYLINDER AND MEANS FOR POWERING A SECOND PNEUMATIC UNIT

[75] Inventor: Jerry E. Vaughn, Bloomington, Minn.

[73] Assignee: Tol-O-Matic, Inc., Minneapolis, Minn.

[21] Appl. No.: 20,073

[22] Filed: Feb. 27, 1987

[51] Int. Cl.[4] ..... F01B 29/00

[52] U.S. Cl. ..... 92/88; 92/9; 91/520

[58] Field of Search ..... 92/88, 9, 163, 164, 92/23; 91/520; 244/63

[56] References Cited

U.S. PATENT DOCUMENTS

| | | | |
|---|---|---|---|
| 2,089,202 | 8/1937 | Gartin | 92/88 |
| 2,891,514 | 6/1959 | Moeller | 92/9 |
| 3,145,588 | 8/1964 | King | 92/88 |
| 4,664,020 | 5/1987 | Kaiser | 92/88 |

FOREIGN PATENT DOCUMENTS

| | | | |
|---|---|---|---|
| 270425 | 6/1971 | U.S.S.R. | 91/520 |
| 26256 | of 1907 | United Kingdom | 92/15 |

*Primary Examiner*—Robert E. Garrett
*Assistant Examiner*—Thomas E. Denion
*Attorney, Agent, or Firm*—Dorsey & Whitney

[57] ABSTRACT

A pneumatic cylinder having an elongatged cylinder member, a reciprocally movable piston, an elongated slot formed in the cylinder member, a seal for sealing the slot during reciprocal movement of the piston and a transfer means for transferring reciprocal movement of the piston to a workpiece. The above pneumatic cylinder includes a mechanisn for providing pneumatic fluid pressure to a secondary pneumatic unit connected to, and movable with, the piston including a manifold connected with the transfer means and conduit members extending from the pneumatic chambers in the cylinder member for directing pneumatic pressure from such chambers to the transfer means.

16 Claims, 2 Drawing Sheets

PNEUMATIC CYLINDER AND MEANS FOR POWERING A SECOND PNEUMATIC UNIT

BACKGROUND OF THE INVENTION

The present invention relates generally to improvements in a pneumatic cylinder, and more particularly, to a pneumatic cylinder, such as a rodless band cylinder having means for powering a secondary pneumatic unit secured to the reciprocally movable force transfer bracket associated with the cylinder.

Several types of pneumatic cylinders currently exist in the art, including, among possible others, cable cylinders and rodless or band cylinders. Although the features of the present invention may be applicable to any of these cylinders, it has particular application to rodless or rodless band cylinders of the type generally described in U.S. Pat. No. 4,545,290, the disclosure of which is incorporated herein by reference. Such a rodless cylinder includes an elongated cylinder member having an elongated, logitudinally extending slot, a piston reciprocally movable within the cylinder member, a sealing band or means for successively sealing the slot during reciprocal movement of the piston and a force transfer bracket for transferring the reciprocal movement of the piston to a workpiece outside of the cylinder. In some applications this force transfer bracket is connected directly to the desired workpiece in the form of a piston bracket, while in other applications the piston bracket is connected to a carrier bracket of the type described in pending U.S. application Ser. No. 810,403, filed Dec. 18, 1985, the disclosure of which is incorporated herein by reference. In this latter application, the workpiece is connected to the carrier bracket.

There are situations when it is desired to mount a second pneumatic unit, such as a secondary pneumatic cylinder, a pneumatic rotary actuator or some other pneumatic tool or device directly to the carrier bracket for reciprocal movement therewith. In such an application, this secondary pneumatic unit is normally designed for actuation either prior to, during or at the end of the stroke of the primary cylinder. A problem which exists with respect to this particular application is the difficulty in providing a source of air or other pneumatic pressure to this secondary pneumatic unit. Currently, when such an application is desired, hoses, tubes or other conduits are connected between a pneumatic power source and this secondary pneumatic unit to power the same. Such a structure, of course, can be quite cumbersome, complicated and expensive, particularly if the stroke of the primary cylinder is quite long. In such a case, the hoses or other conduits supplying the pneumatic power to the secondary pneumatic unit would have to be at least as long as the length of the primary cylinder and there would need to be means to take up the hose or conduit and to keep it from interfering with the rest of the operation during reciprocation of the secondary pneumatic unit along the stroke of the primary cylinder. While this is obviously less of a problem with primary cylinders of relatively short strokes, on the order of six inches to a foot, some of the primary cylinders can be twenty feet or longer.

Accordingly, there is a need in the art for an improved means for supplying pneumatic pressure to a secondary pneumatic unit connected to and movable with the reciprocating piston or carrier bracket of a pneumatic cylinder such as a rodless cylinder.

SUMMARY OF THE INVENTION

In accordance with the present invention, a pneumatic cylinder of the rodless type is provided with an improved means for providing a source of pneumatic power to a secondary pneumatic unit mounted to and movable with the piston or carrier bracket of the primary cylinder. More particularly, this means includes a specially designed cylinder piston, a pair of conduits extending between such piston and the secondary pneumatic unit and various modifications to a conventional rodless cylinder so that the pneumatic power which is utilized to drive the primary cylinder is directed to a manifold secured to the piston or carrier bracket for driving the secondary pneumatic unit. More particularly, the means includes tapping into the center portion of each end of the primary piston to provide access to the pneumatic pressure within each chamber of the primary cylinder. Means are also provided for connecting this pneumatic power through appropriate conduit means to the above-mentioned manifold for driving the secondary pneumatic unit.

In a preferred embodiment of the invention, the primary cylinder is provided with a carrier bracket having a pair of support or guide arms extending outwardly from a center portion and around a portion of the tubular cylinder member. A guide or bearing rod is then secured relative to each of these guide or support arms so that the rods are disposed between an inner surface portion of each of the arms and a corresponding bearing surface on the outside surface of the cylinder side walls. Means are also provided for controlling the breakaway force needed for the primary cylinder. As will be described in greater detail below, the relationship between the breakaway forces of the primary and secondary pneumatic units determine whether the secondary pneumatic unit is actuated at the beginning or the end of the primary cylinder stroke.

Accordingly, it is an object of the present invention to provide an improved rodless cylinder having a secondary pneumatic unit mounted to and movable with the piston or carrier bracket and means for supplying pneumatic power to such secondary pneumatic unit.

Another object of the present invention is to provide improved rodless cylinder of the type described above in which the pneumatic power for driving the secondary pneumatic unit is taken from the same source powering the primary pneumatic cylinder.

A further object of the present invention is to provide a rodless cylinder of the type described above in which the power for driving the secondary pneumatic unit is taken directly from the pneumatic chambers on each end of the piston in the primary pneumatic cylinder.

A still further object of the present invention is to provide a rodless cylinder of the type described above in combination with a carrier bracket in which the clearance between the bearing rods of the carrier bracket and the side walls of the cylinder can be adjusted to assist in controlling the breakaway force in the primary cylinder and thus actuation of the secondary pneumatic unit.

These and other objects of the present invention will become apparent with reference to the drawings, the description of the preferred embodiment, and the appended claims.

DESCRIPTION OF THE PREFERRED EMBODIMENT

Figures 1, 11, 12:
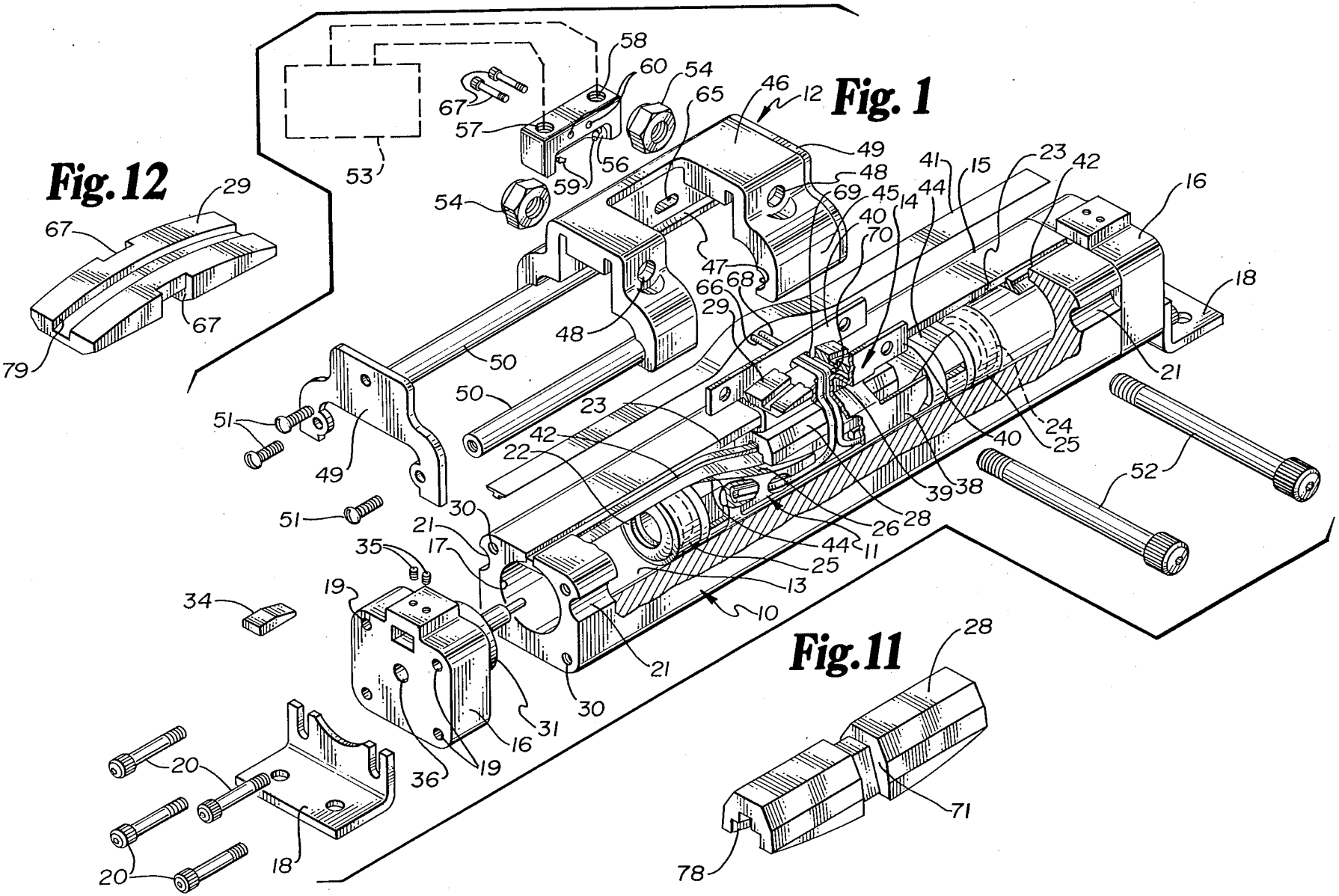
FIG. 1 is a pictorial, exploded view, with portions broken away, showing the rodless cylinder of the present invention and the improved means for supplying the secondary pneumatic unit with pneumatic power.
FIG. 11 is a pictorial view of the inner or lower band ramp of the pneumatic cylinder of the present invention.
FIG. 12 is a pictorial view of the outer or upper band ramp of the pneumatic cylinder of the present invention.

Reference is first made to FIG. 1 showing a pictorial, exploded view, with portions broken away, of the improved pneumatic cylinder of the present invention. As generally illustrated in FIG. 1, the rodless cylinder includes an elongated cylinder assembly 10 having an elongated, longitudinally extending slot 23, a piston assembly 11 adapted for reciprocal movement within the cylinder 10 and a carrier bracket assembly 12. The carrier bracket assembly 12 is connected with the piston assembly 11 through the piston bracket 14 and functions to stabilize movement of the piston 11 and a workpiece (not shown) and guide the same during its reciprocal movement relative to the cylinder 10.

More specifically, the cylinder assembly 10 includes a generally elongated tubular member or cylinder 15 having a generally cylindrical bore 17 extending throughout its entire length along its longitudinal axis. An elongated slot 23 is formed in a top wall of the cylinder 15 and a pair of bearing surfaces comprising guide channels or grooves 21 are formed in the outer side walls of the cylinder member 15. As will be described in greater detail below, these guide channels or grooves 21 (one formed in each of the cylinder side walls) cooperate with corresponding bearing rods associated with the carrier bracket assembly 12 for the purpose of guiding the carrier bracket 12 and the piston assembly 11 during their reciprocal movement.

An end or head assembly 16 is connected to each end of the cylinder 15. Each such assembly 16 is provided with a plurality of openings 19, which are aligned with corresponding threaded openings 30 in the ends of the cylinder 15. A like number of threaded members 20 extend through the openings 19 in each head assembly 16 for threaded connection into the openings 30. When the threaded members 20 are tightened, the head assembly 16 is secured to a respective end of the cylinder 15 in a fixed, sealed relationship.

A portion 31 extends inwardly from each of the head assemblies 16 for insertion into the cylindrical bore 17 of the cylinder 15. A peripheral portion of each of these portions 31 is provided with an O-ring or other sealing member for the purpose of providing a sealed relationship between the portion 31 and the inner surface of the bore 17. A mounting bracket 18 is also provided at each end of the cylinder assembly 10 for the purpose of mounting the same to a desired surface or location. Each of the brackets 18 includes a pair of mounting holes and cylinder connection means for this purpose. Means are also provided in the form of the wedge element 34 and the set screws 35 at each end of the cylinder assembly for securing the elongated seal members in fixed relationship relative to the head assemblies 16. A fluid inlet/outlet port 36 is provided in each of the head assemblies 16 for selectively providing fluid pressure to and from fluid chambers within the cylinder assembly 10.

The piston assembly 11 is adapted for reciprocal movement within the cylindrical bore within the cylinder 15 and includes a main piston body comprising a centrally located portion 26 and a pair of end portions 22, 24 positioned at the end of the piston. A piston bracket 14 is connected with the central portion 26 on each side thereof and extends upwardly through the slot 23 as illustrated best in FIG. 1. More specifically, this piston bracket 14 includes a pair of spaced, lower connecting portions 38 for connecting the piston bracket 14 to the central portion 26 of the piston, a narrow central portion 39 which extends upwardly through the slot 23, and a pair of spaced upper connecting bracket members 40 for connection with the carrier bracket 12.

Elongated outer and inner band or seal members 41 and 42, respectively, are adapted for insertion into a portion of the elongated slot 23 during operation for the purpose of successively sealing the slot during reciprocal movement of the piston 11. Associated with the piston 11 and the piston bracket 14 are a pair of seal member guide ramps 28 and 29 for guiding the inner and outer seal members 42, 41, out of sealing engagement with the slot 23 during reciprocal movement of the piston. Each end of the piston 11 is also provided with a ramp or guide portion 44 for guiding the inner seal member 42 into the slot 23 during reciprocation of the piston 11. The outer seal member 41 is guided into the slot 23 by a portion of the carrier bracket end plate 49.

Each of the piston ends 22 and 24 includes a seal 25. Thus, when the piston assembly 11 is positioned within the cylinder bore 17, the seals 25 engage the inner surface of the bore in sealing relationship. This defines pneumatic fluid chambers 13 and 23 in the ends of the cylinder 15. One of the fluid chambers 13 is connected to one of the fluid inlet/outlet ports 36 at one end of the cylinder, while the other fluid chamber 23 is connected to the fluid inlet/outlet port at the other end of the cylinder. By controlling the supply and exhaust of fluid pressure to and from the ports at the ends of the cylinders, the piston assembly 11 is caused to move reciprocally back and forth within the bore 17 along the longitudinal axis of the cylinder 15.

The carrier bracket 12 includes a pair of spaced apart leg portions 45 which extend outwardly from a central portion 46. Each of these leg portions 45 extends partially around the outer side surfaces of the cylinder 15 and includes a bearing seat or groove 47 for engagement with an elongated bearing rod 50. The bearing rods 50, in turn, are intended for sliding relationship relative to the grooves 21 on the outer side surfaces of the cylinder 15. An end cap 49 is connected with each end of the central portion 46 of the carrier bracket 12 and to the ends of the bearing rods 50. Appropriate screws or other connecting means 51 are provided for these connections. The central portion 46 of the carrier bracket 12 is provided with a pair of lateral openings 48, 48 for corresponding connection to the spaced, upwardly extending connecting portions 40 of the piston bracket 14. A pair of threaded bolts 52 and nuts 54 are provided for this connection. It should be noted that the carrier bracket 12 illustrated in FIG. 1 shows a portion being cut away from the central portion 46 and one of the leg portions 45. This is solely for illustration purposes. In the actual preferred embodiment, the carrier bracket 12 is a solid structure with no such cut away portion.

Figure 9:
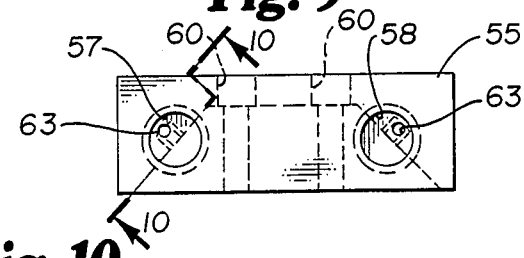
FIG. 9 is an elevational top view of the manifold of the present invention.
Figure 8:
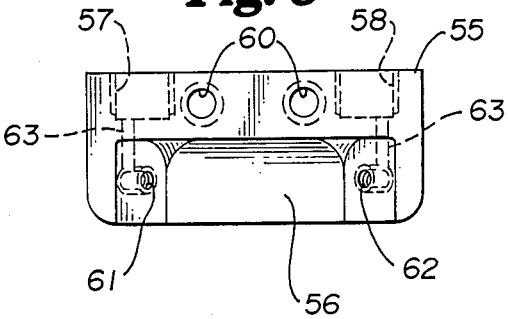
FIG. 8 is an elevational side view of the manifold of the present invention.

Connected to one side surface of the central portion 46 of the carrier bracket 12 is a manifold 55 for use in providing a source of pneumatic pressure to a secondary pneumatic device. This secondary pneumatic device is illustrated schematically in FIG. 1 by the reference numeral 53. The manifold 55 is illustrated pictorially in FIG. 1 and via elevational and sectional views in FIGS. 8, 9 and 10. In the preferred embodiment the manifold 55 is connected with the side of the carrier bracket 12 by a pair of threaded members 67 extending through the connection openings 60 and into a side of the central portion of the carrier bracket 12. A recessed portion 56 is embodied within the manifold 55 on the side facing the carrier bracket 12. As illustrated best in FIGS. 8, 9, and 10, and also to some extent in FIG. 1, the manifold 55 includes a pair of openings or ports 61 and 62 positioned within the recessed portion 56 and communicating, through the openings 63 to respective inlet/outlet ports 57, 58. The inlet/outlet ports 57, 58 are provided with internal threads so that they can be connected, through appropriate conduit or other means to the operative inlet/outlet ports of the secondary pneumatic unit 53 which is connectable to, or movable with, the carrier bracket 12. Such a connection can be via connection with the ports 57, 58 or can be via direct connection with the carrier bracket 12 in addition to the ports 58. Each of the ports 61, 62 (FIG. 8) is provided with a barbed fitting 59 (FIG. 1) which is secured within the ports 61, 62. These barbed fittings 59 are threadedly received in the ports 61, 62 and include an outer end for connection with an end of a piece of polyurethane tubing.

The side wall portion of the carrier bracket 12 to which the manifold 55 is connected is provided with an opening 65 to provide access between the ports 61, 62 (FIG. 8) and the interior of the cylinder 15. A pair of polyurethane tubing or conduit sections 66 and 68 extend through the opening 65 and are directly connected to the ports 61, 62 via the barbed connectors 59, 59. These sections of polyurethane tubing 66, 68 then extend in a similar manner through an opening 69 in one of the piston bracket connector members 40, through a recessed portion 67 (FIGS. 6, 7, and 11) on the bottom side of the outer seal ramp 29, and through an opening 70 (FIG. 1) in the central portion 39 of the piston bracket 14. The tubing sections 66 and 68 then extend above and to one side of the inner seal ramp 28 through the recessed portion 71 (FIGS. 4, 5 and 10) and through various openings in the central portion 26 of the piston assembly 11 for connection to the ports 72, 73, respectively (FIG. 2) in the ends of the piston 14.

Figure 2:
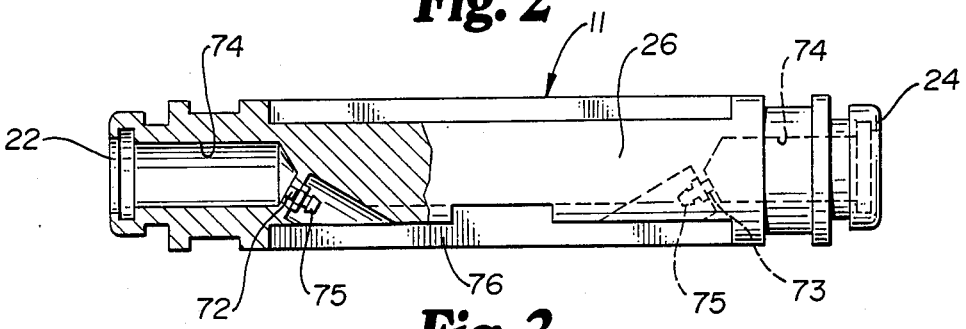
FIG. 2 is a top view, partially in section, of the primary cylinder piston usable in the rodless cyinder of the present invention.
Figure 3:
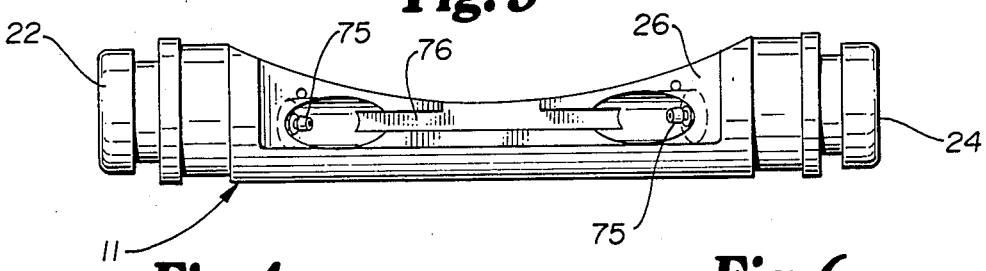
FIG. 3 is an elevational side view of the primary cylinder piston shown in FIG. 2.

As shown best in FIGS. 2 and 3, each end 22, 24 of the piston 14 includes an inwardly extending bore 74, 74 which communicates directly with the ports 72, 73. With this construction, the pneumatic chambers at each end of the cylinder 15 are in direct communication with the bores 74, 74 and thus the ports 72, 73. As also shown in FIGS. 2 and 3, a barbed tubing connector 75 is threadedly connected with each of the ports 72, 73. These connectors 75 are then connected with the ends of the tubing sections 66 and 68. As illustrated best in FIG. 2, one side of the piston member includes a hollowed out or recessed portion 76 to accommodate the tubing sections 66 and 68.

Figure 4:
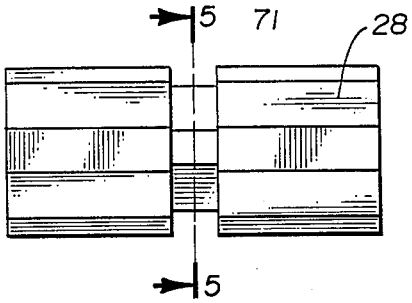
FIG. 4 is a top elevational view of the inner band ramp of the present invention.
Figure 5:
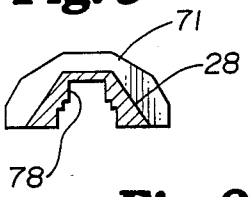
FIG. 5 is a view, partially in section, as viewed along the section line 5—5 of FIG. 4.
Figure 10:
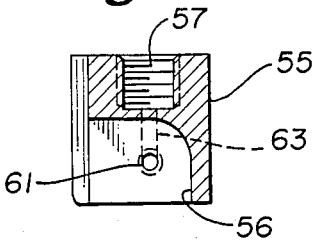
FIG. 10 is a view, partially in section, of the manifold of the present invention as viewed along the section line 10—10 of FIG. 9.

As shown best in FIGS. 4, 5 and 10, the inner seal member ramp 28 includes a recessed central portion 71 for accommodating passage of the tubing sections 66 and 68 from the piston 11 to the opening 70 in the central part of the piston bracket 14. The ramp 28 also includes a recessed portion 78 having an internal configuration for guiding the inner seal member 42. As shown, the recessed portion 71 and the recessed portion 78 are on opposite sides of the ramp member 28.

Figure 6:
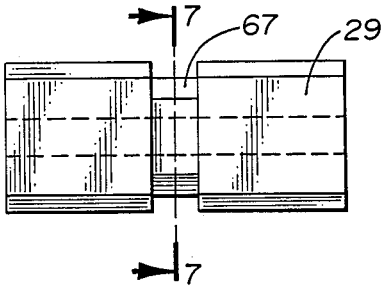
FIG. 6 is a bottom elevational view of the outer band ramp of the present invention.
Figure 7:
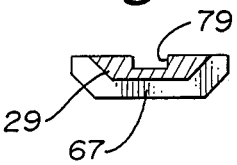
FIG. 7 is a view, partially in section, as viewed along the section line 7—7 of FIG. 6.

As shown best in FIGS. 6, 7 and 11, the outer seal ramp member 29 similarly includes a recessed portion 67 for accommodating passage of the tubing sections 66, 68 from the opening 70 to the opening 69 in the bracket member 40. The ramp 29 also includes a recessed portion 79 to guide the outer seal member 41 during reciprocal movement of the piston. As illustrated, these recessed portions 67 and 79 are on opposite sides of the ramp member 29. It should be noted that portions of the ramp member 29 as shown on FIG. 1 have been removed for illustrative purposes so that the path of the tubing sections 66, 68 can be seen.

During operation, the relationship between the breakaway forces for the primary cylinder and the secondary pneumatic unit will determine whether the secondary pneumatic device connected to the manifold 55 will move prior to the movement of the piston assembly 11, or after. If the breakaway force needed to move the secondary pneumatic unit 53 is less than the breakaway force needed to move the piston assembly 11, the secondary pneumatic unit 53 will actuate or move first In contrast, if the breakaway force for the secondary pneumatic unit 53 is greater than that required for the primary cylinder, the piston of the primary cylinder will move first.

For example, if the breakaway pressure needed to move the primary piston assembly 11 from one end of the cylinder to the other is 75 psi, and the breakaway pressure needed to actuate the secondary pneumatic unit 53 is 50 psi, the apparatus will function as follows. First, upon introduction of pneumatic pressure into the left-hand chamber 13 of the cylinder 15, the pressure will continue to build and at the same time will be directed through the port 72 (FIG. 2) and the tubing section 66 to the port 57 and the corresponding pneumatic chamber in the secondary pneumatic device. When the pressure reaches 50 psi, the secondary pneumatic unit 53 will actuate. Following the initial cycle of such actuation, the pressure will continue to rise in the chamber 13 until it reaches 75 psi, at which time the piston assembly 11 in the primary cylinder will move from the left end of the cylinder 15 to the right. As a result of appropriate reversing mechanisms, pneumatic fluid will then be introduced into the pneumatic chamber 23 on the right-hand end of the cylinder 15. The pressure in this chamber 23 will continue to build and will be directed through the port 73 (FIG. 2) and the tubing section 68 to the port 58 and thus the corresponding chamber in the secondary pneumatic unit 53. When the pressure has climbed to 50 psi, the secondary pneumatic device will be actuated. The pressure in the primary cylinder chamber 23 will then continue to rise until it reaches 75 psi, at which time the piston assembly 11 will move from the right end to the left end of cylinder 15. The above cycle is then repeated.

If the breakaway force needed for movement of the piston assembly 11 is less than the breakaway force needed to actuate the secondary pneumatic unit 53, the primary cylinder will actuate first. For example, if the breakaway force needed to move the piston assembly 11 is 25 psi and the force needed to move the secondary unit 53 is 50 psi, and the piston assembly 11 starts out at the left end of the cylinder 15, introduction of pneumatic pressure into the left-hand chamber 13 of the cylinder 15 will cause a rise in pressure in that chamber. When it reaches 25 psi, the piston assembly 11 will move from the left end of the cylinder to the right. Pneumatic pressure will then continue to be introduced into the left-hand chamber of the cylinder 21 and also directed via the tubing section 66 to the port 57 and thus the corresponding chamber in the secondary pneumatic device until a pressure of 50 psi is reached, at which time the second pneumatic unit 53 will be actuated. Then, again, as a result of conventional reversing means, pneumatic pressure will be introduced into the pneumatic chamber 23 on the right-hand end of the cylinder 15. When this pressure reaches 25 psi, the piston assembly 11 will move from the right end to the left end of the cylinder 15. Pressure will be directed via the tubing 68 to the port 58 and will continue to increase until it reaches 50 psi, at which time the secondary pneumatic device will be actuated in the reverse direction.

It is contemplated that the conventional reversing mechanism will be triggered by a sensor or other means utilized to sense a particular location of the cylinder having the higher breakaway force and thus moving second. This delays the reversing action until both cylinders or units have moved.

There are a variety of ways in which the breakaway force of a particular pneumatic cylinder or unit can be varied. One way is in the design of the cylinder or unit itself. A second way is to adjust the back pressure or flow control of the particular cylinder or unit. A third way is to control movement of the cylinder or unit via a spool or other valve mechanism. A fourth way is to adjust the breakaway force of the primary cylinder by increasing or decreasing the frictional forces between the carrier bracket and the cylinder 15 as shown in the preferred embodiment.

As previously stated, the carrier bracket 12 is mounted relative to the cylinder 15 via connecting bolts 52. By controlling the tension on the bolts 52, the outwardly extending leg portions 45, 45, which are prestressed outwardly, can be moved inwardly or outwardly. This in turn causes inward and outward movement of the bearing rods 50, 50 relative to the bearing grooves 21 in the side walls of the cylinder 15. The more the bolts 52 are tightened or tensioned, the greater the frictional force between the bearing rods 50 and the grooves 21, and thus the greater the pressure that will be needed to move the piston assembly 11 in reciprocal movement within the cylinder 15.

Although the mechanism described above contemplates a secondary pneumatic device which functions in a reciprocal or cyclical fashion, it is contemplated that the present invention could be modified to provide a relatively constant source of pneumatic pressure, through a single port, to a secondary pneumatic device such as a hydraulic motor or the like. To do this, an appropriate check valve mechanism would be needed within the passageway leading from the respective chambers in the cylinder 15 to the secondary pneumatic device to prevent air pressure from flowing back into these chambers. In such a mechanism, the pneumatic pressure will be exhausted at the secondary pneumatic device.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

I claim:

1. A pneumatic cylinder comprising:

an elongated cylinder member having first and second ends and an elongated bore extending threrethrough;

a piston having first and second ends disposed within said bore and adapted for reciprocal movement therein;

an elongated slot formed in said cylinder member and extending in a direction generally parallel to the longitudinal axis of said cylinder member;

seal means for successively sealing said slot during reciprocal movement of said piston;

transfer means connected to and movable with said piston for transferring reciprocal movement of said piston to a workpiece;

first and second pneumatic chambers defined within said bore between said first ends of said cylinder member and said piston and between said second ends of said cylinder member and said piston, respectively;

a first pneumatic pressure inlet/outlet port in said cylinder member for selectively providing pneumatic pressure to said first pneumatic chamber;

a second pneumatic pressure inlet/outlet port in said cylinder member for selectively providing pneumatic pressure to said second pneumatic chamber;

means for connecting a second pneumatic unit to said transfer means for movement therewith;

first and second conduit means in communication with said first and second pneumatic chambers, respectively, and movable with said transfer means for directing pneumatic pressure from within said first and second pneumatic unit, whereby said second pneumatic unit is driven by pressure from said first and second pneumatic chambers; and force adjustment means for adjusting the breakaway force needed to move said piston within said bore.

2. The cylinder of claim 1 wherein said first and second ends of said piston include a piston port in communication with said first and second pneumatic chambers, respectively, and means for connecting said piston ports to said first and second conduit means.

3. The cylinder of claim 1 including manifold means connected with said transfer means and having first and second manifold ports for directing pneumatic pressure to said second pneumatic unit.

4. The cylinder of claim 1 wherein said force adjustment means includes means for creating braking engagement between said transfer means and said cylinder member.

5. The cylinder of claim 1 wherein said transfer means includes a carrier bracket connected with said piston for movement therewith, said carrier bracket including force adjustment means for adjusting the breakaway force needed to move said piston within said bore.

6. The cylinder of claim 5 wherein said force adjustment means includes, means for creating braking engagement between said carrier bracket and said cylinder member.

7. The cylinder of claim 6 wherein said carrier bracket includes a central portion and a pair of arms extending outwardly from said central portion and partially around said cylinder member.

8. The cylinder of claim 7 wherein said cylinder member includes a bearing surface on opposite side walls thereof and each of said arms includes a bearing member for sliding relationship with said bearing surfaces.

9. The cylinder of claim 8 wherein said bearing surfaces include a bearing groove on each side wall of each cylinder member and said bearing members include an elongated bearing rod.

10. The cylinder of claim 9 wherein said arms are adapted for limited movement toward and away from one another and said force adjustment means includes means for selectively moving said arms toward and away from one another.

11. The cylinder of claim 10 wherein said means for selectively moving said arms toward and away from one another includes a threaded member.

12. The cylinder of claim 7 wherein said arms are adapted for limited movement toward and away from one another and said force adjustment means includes means for selectively moving said arms toward and away from one another.

13. The cylinder of claim 5 including manifold means connected with said carrier bracket.

14. The cylinder of claim 5 wherein said transfer means further includes a piston bracket connected with said piston and extending through said slot and said carrier bracket is connected with said piston bracket.

15. The cylinder of claim 5 including means for connecting a secondary pneumatic unit to said carrier bracket for movement therewith.

16. The cylinder of claim 1 including a pathway for said first and second conduits extending from said first and second piston ports, through said elongated slot and to said secondary pneumatic unit.

* * * * *